US006036622A

United States Patent [19]

Gordon

[11] Patent Number: 6,036,622

[45] Date of Patent: Mar. 14, 2000

[54] EXERCISE DEVICE

[76] Inventor: Joel D. Gordon, 3311 Woodvalley Dr., Baltimore, Md. 21208

[21] Appl. No.: 09/169,463

[22] Filed: Oct. 9, 1998

Related U.S. Application Data

[60] Provisional application No. 60/073,049, Jan. 29, 1998, and provisional application No. 60/061,686, Oct. 10, 1997.

[51] Int. Cl.[7] ..... A63B 22/00; A63B 23/04

[52] U.S. Cl. ..... 482/51; 482/51; 482/70

[58] Field of Search ..... 482/51, 52, 53, 482/57, 70, 71, 79, 80; 601/23, 27, 34

[56] References Cited

U.S. PATENT DOCUMENTS

| | | | |
|---|---|---|---|
| 219,439 | 9/1879 | Blend . | |
| 3,316,898 | 5/1967 | Brown | 128/25 |
| 3,316,899 | 5/1967 | Raeder | 128/63 |
| 3,970,302 | 7/1976 | McFee | 272/130 |
| 3,995,491 | 12/1976 | Wolfla, II | 73/379 |
| 4,023,795 | 5/1977 | Pauls | 272/97 |
| 4,053,173 | 10/1977 | Chase | 280/253 |
| 4,185,622 | 1/1980 | Swenson | 128/25 |
| 4,188,030 | 2/1980 | Hooper | 272/73 |
| 4,379,566 | 4/1983 | Titcomb | 280/251 |
| 4,456,276 | 6/1984 | Bortolin | 280/257 |
| 4,456,279 | 6/1984 | Bortolin | 280/257 |
| 4,470,597 | 9/1984 | McFee | 272/128 |
| 4,496,147 | 1/1985 | DeCloux et al. | 272/130 |
| 4,509,742 | 4/1985 | Cones | 272/73 |
| 4,555,109 | 11/1985 | Hartmann | 272/73 |
| 4,561,318 | 12/1985 | Schirrmacher | 74/54 |
| 4,679,786 | 7/1987 | Rodgers | 272/70 |
| 4,685,666 | 8/1987 | DeCloux | 272/70 |
| 4,708,338 | 11/1987 | Potts | 272/70 |
| 4,709,918 | 12/1987 | Grinblat | 272/97 |
| 4,720,093 | 1/1988 | Del Mar | 272/70 |
| 4,733,858 | 3/1988 | Lan | 272/70 |
| 4,779,863 | 10/1988 | Yang | 272/114 |
| 4,786,050 | 11/1988 | Geschwender | 272/73 |
| 4,799,863 | 1/1989 | Yang | 272/114 |
| 4,850,585 | 7/1989 | Dalebout | 272/70 |
| 4,869,494 | 9/1989 | Lambert, Sr. | 272/73 |
| 4,900,013 | 2/1990 | Rodgers, Jr. | 272/70 |
| 4,940,233 | 7/1990 | Bull et al. | 272/130 |
| 4,949,954 | 8/1990 | Hix | 272/73 |
| 4,949,993 | 8/1990 | Stark et al. | 270/70 |
| 4,951,942 | 8/1990 | Walden | 272/135 |
| 4,989,857 | 2/1991 | Kuo | 272/70 |
| 5,000,442 | 3/1991 | Dalebout et al. | 272/70 |
| 5,000,443 | 3/1991 | Dalebout et al. | 272/70 |
| 5,038,758 | 8/1991 | Iams et al. | 128/75 |
| 5,039,087 | 8/1991 | Kuo | 272/70 |
| 5,039,088 | 8/1991 | Shifferaw | 272/73 |
| 5,040,786 | 8/1991 | Jou | 272/70 |
| 5,048,821 | 9/1991 | Kuo-Liang | 272/70 |
| 5,062,627 | 11/1991 | Bingham | 272/70 |
| 5,129,872 | 7/1992 | Dalton et al. | 482/52 |
| 5,131,895 | 7/1992 | Rogers, Jr. | 482/70 |
| 5,135,447 | 8/1992 | Robards, Jr. et al. | 482/52 |
| 5,149,312 | 9/1992 | Croft et al. | 482/62 |
| 5,186,697 | 2/1993 | Rennex | 482/52 |
| 5,195,935 | 3/1993 | Fencel | 482/70 |
| 5,242,343 | 9/1993 | Miller | 482/57 |
| 5,279,529 | 1/1994 | Eschenbach | 482/57 |
| 5,279,530 | 1/1994 | Hess | 482/70 |

(List continued on next page.)

FOREIGN PATENT DOCUMENTS 29 19 494 11/1980 Germany .

*Primary Examiner*—Stephen R. Crow

[57] ABSTRACT

An exercise device for use by a user, said exercise device comprising a frame, first and second linkages pivotally carried by a frame, each of the linkages including an upper link and a lower link; each of the upper links being pivotally connected to the frame, each of the lower links being pivotally connected to the upper link; first and second foot supports, the first foot support carried by the lower link of the first linkage and the second foot support carried by the lower link of the second linkage; and means for coupling the movement of the first foot support and the second foot support whereby the user of the exercise device may perform a walking, striding, or stepping exercise without reconfiguring the exercise device.

20 Claims, 15 Drawing Sheets

U.S. PATENT DOCUMENTS

| | | | |
|---|---|---|---|
| 5,290,211 | 3/1994 | Stearns | 482/53 |
| 5,295,928 | 3/1994 | Rennex | 482/52 |
| 5,299,993 | 4/1994 | Habing | 482/52 |
| 5,336,141 | 8/1994 | Vittone | 482/51 |
| 5,352,169 | 10/1994 | Eschenbach | 482/57 |
| 5,383,829 | 1/1995 | Miller | 482/57 |
| 5,401,226 | 3/1995 | Stearns | 482/53 |
| 5,419,747 | 5/1995 | Piaget et al. | 482/51 |
| 5,423,729 | 6/1995 | Eschenbach | 482/70 |
| 5,496,235 | 3/1996 | Stevens | 482/51 |
| 5,518,473 | 5/1996 | Miller | 482/57 |
| 5,527,246 | 6/1996 | Rodgers, Jr. | 482/57 |
| 5,529,554 | 6/1996 | Eschenbach | 482/57 |
| 5,529,555 | 6/1996 | Rodgers, Jr. | 482/57 |
| 5,540,637 | 7/1996 | Rodgers, Jr. | 482/55 |
| 5,549,526 | 8/1996 | Rodgers, Jr. | 482/57 |
| 5,573,480 | 11/1996 | Rodgers, Jr. | 482/57 |
| 5,577,985 | 11/1996 | Miller | 482/52 |
| 5,593,371 | 1/1997 | Rodgers, Jr. | 482/51 |
| 5,593,372 | 1/1997 | Rodgers, Jr. | 482/52 |
| 5,595,553 | 1/1997 | Rodgers, Jr. | 482/51 |
| 5,611,756 | 3/1997 | Miller | 482/52 |
| 5,637,058 | 6/1997 | Rodgers Jr. | 482/51 |
| 5,735,773 | 4/1998 | Vittone et al. | 482/52 |
| 5,746,681 | 5/1998 | Bull | 482/53 |
| 5,769,760 | 6/1998 | Lin et al. | 482/57 |
| 5,788,610 | 8/1998 | Eschenbach | 482/51 |
| 5,792,026 | 8/1998 | Maresh et al. | 482/51 |
| 5,792,027 | 8/1998 | Gvoich | 482/51 |
| 5,792,028 | 8/1998 | Jarvie | 482/51 |
| 5,792,029 | 8/1998 | Gordon | 482/52 |
| 5,813,949 | 9/1998 | Rodgers, Jr. | 482/70 |
| 5,857,940 | 1/1999 | Husted | 482/70 |
| 5,910,072 | 6/1999 | Rawls et al. | 482/52 |

EXERCISE DEVICE

CROSS-REFERENCE TO RELATED APPLICATIONS

This application claims the benefit of United States provisional application Ser. No. 60/073,049 filed Jan. 29, 1998, and United States provisional application Ser. No. 60/061,686 filed Oct. 10, 1997, the disclosures of which are incorporated herein by reference.

BACKGROUND OF THE INVENTION

1. Technical Field

The present invention relates generally to exercise equipment and, more particularly, to an exercise device permitting a user to perform walking, striding and stair stepping exercises.

2. Background Information

A variety of exercise devices have been developed to simulate activities found to be effective in conditioning the body. One type of exercise device, exemplified by U.S. Pat. Nos. 3,970,302 to McFee, U.S. Pat. No. 4,685,666 to DeCloux, and U.S. Pat. No. 5,129,872 to Dalton et al. permits a user to perform a stair stepping exercise simulating the climbing stairs. Another type of exercise device, exemplified by U.S. Pat. Nos. 4,850,585 to Dalebout, and U. S. Pat. No. 5,419,747 to Piaget, permits a user to perform a striding exercise simulating cross-country skiing or skating.

A disadvantage of such exercise devices is that the user cannot change the type of exercise being performed without mechanical adjustment of the device. U.S. Pat. Nos. 5,290,211 and 5,401,226 to Stearns disclose an exercise device which permits a user standing on foot supports to perform simultaneously a stair stepping or climbing type exercise and a cross country skiing or skating type exercise. The foot supports are mounted on a pair of generally horizontal linkages pivotally connected with a pair of vertical linkages at a first pivot location disposed at about the same elevation as the user's feet allowing the horizontal linkages to pivot up and down. The vertical linkages are pivotally connected with a frame at a second pivot location spaced forwardly of the user's feet and hips allowing the vertical linkages to swing back and forth. While this type of device permits multiple exercises to be performed, it suffers from many disadvantages when used to simulate some of the exercises described above. For example, a disadvantage of mounting the horizontal linkages in cantilevered relation to the vertical linkages is that some form of force resisting member is needed to prevent the foot supports from impacting the floor during use. In addition, complicated and costly mechanisms such as parallelogram linkages are needed to counteract tilting of the foot supports in directions opposite the natural direction of tilt of the user's feet during certain types of exercises; and, even with such tilt correcting mechanisms, the foot supports are always maintained in a generally horizontal position which does not necessarily correspond to the natural movement of the foot during certain exercises. Also, when used to perform exercises involving swinging of the vertical linkages relative to the frame, the placement of the upper pivots forward of the user's hip causes the foot supports to move in an arc having a geometric center offset from the user's hips, thereby detracting from the overall feel and stability of the device.

SUMMARY OF THE INVENTION

Accordingly, it is a primary object of the present invention to overcome the above-mentioned disadvantages of the prior art and to improve exercise devices of the type which permit striding and walking exercises to be performed.

It is another object of the present invention to accurately simulate striding, stepping and walking exercises with an exercise device by suspending a pair of foot supports from a frame using linkages which pivot at locations corresponding substantially to the user's hips and knees.

It is a further object of the present invention to link horizontal and/or vertical movement of the foot supports in such a device.

It is an additional object of the present invention to link vertical movement of the foot supports in such a device using a cord oriented at an angle relative to one or both of the linkages to prevent knee locking.

The present invention is generally characterized in an exercise device which permits a user to stand upright on a pair of foot supports suspended from a frame and perform walking, striding and stepping exercises simply by altering their leg motion. For example, to perform a striding exercise, users can straighten their legs and swing them forward and backward as if they were cross-country skiing. A stepping exercise can be performed by alternately lifting one knee upward and lowering the other knee. Walking, on the other hand, can be performed by combining the striding and stepping motions so that the legs move forward and backward while the knees move up and down. The walking, striding, and stepping motions are made realistic by use of a suspension system having a pair of upper supports connected to the frame and lower supports pivotally connected to the upper supports at about knee level. The upper support defines the path along which the pivoted end of the lower support can travel during the exercise so that, for example, if the upper support defines an arcuate path having a center of curvature at about hip level, the pivoted end of the lower support can be made to move like an actual knee during walking, striding, and stepping exercises.

Some of the advantages of the present invention over the prior art are that the foot supports can be made to tilt with the user's feet through the entire range of motion during stepping, striding, and walking exercises, that the pivots can be located to guide the user's knees along an arcuate path having a center of curvature near the user's hips, and that the device can be operated without force resisting members attached to the lower links or foot supports.

Other objectives and advantages of the present invention will become apparent from the following description of the preferred embodiments taken in conjunction with the accompanying drawings, wherein like parts in each of the several figures are identified by the same reference numerals.

BRIEF DESCRIPTION OF THE DRAWINGS

The preferred embodiments of the invention, illustrative of the best mode in which applicant contemplated applying the principles of the invention, are set forth in the following description and are shown in the drawings and are particularly and distinctly pointed out and set forth in the appended claims.

DESCRIPTION OF THE PREFERRED EMBODIMENTS

Figure 1:
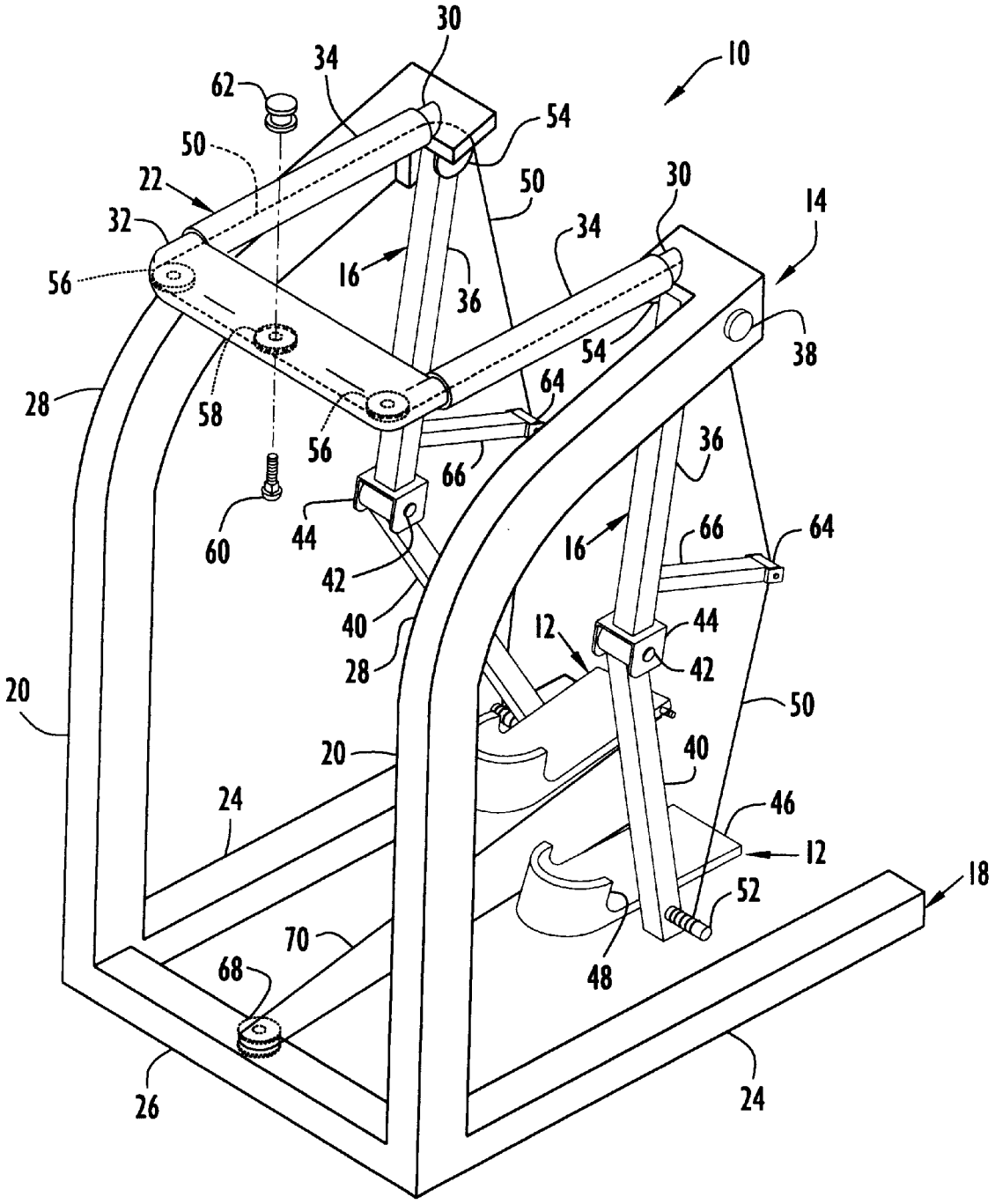
FIG. 1 is a perspective view of an exercise device according to the present invention.
Figure 2:
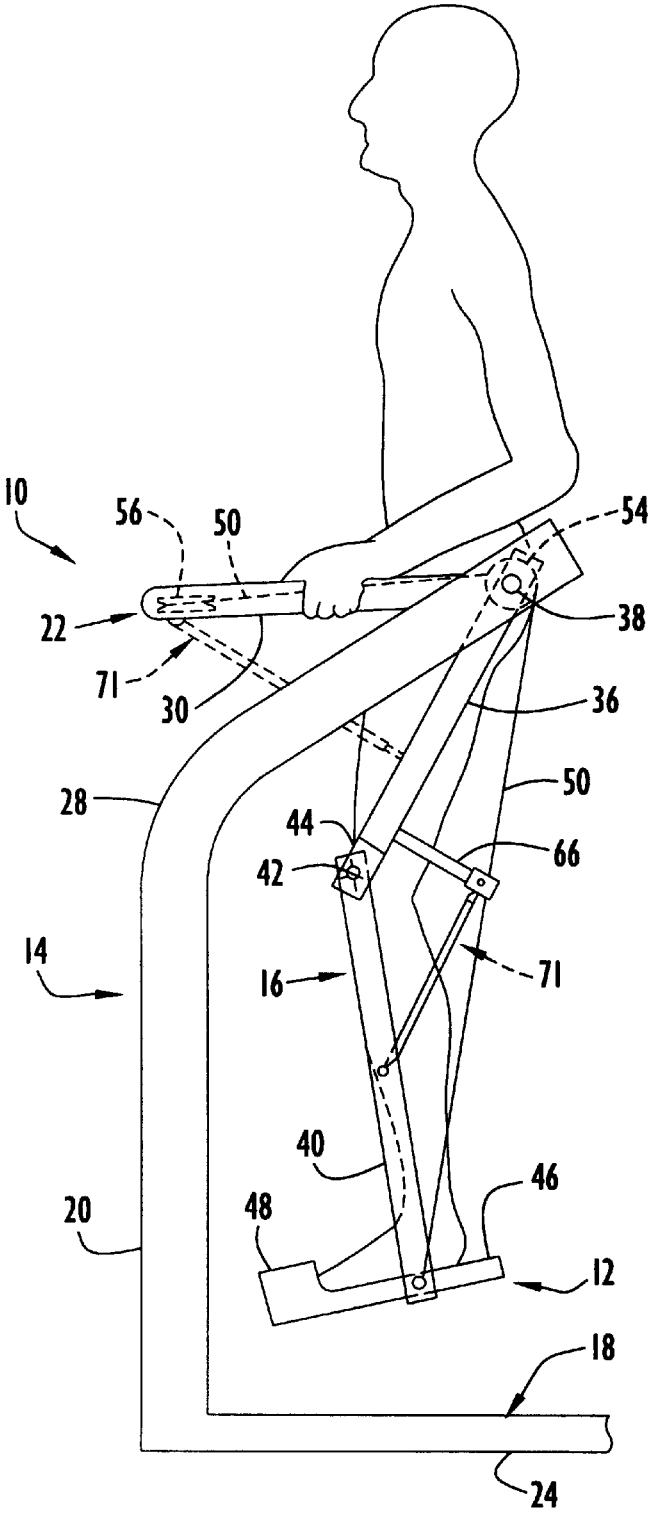
FIG. 2 is a side view of the exercise device shown in FIG. 1.
Figure 3:
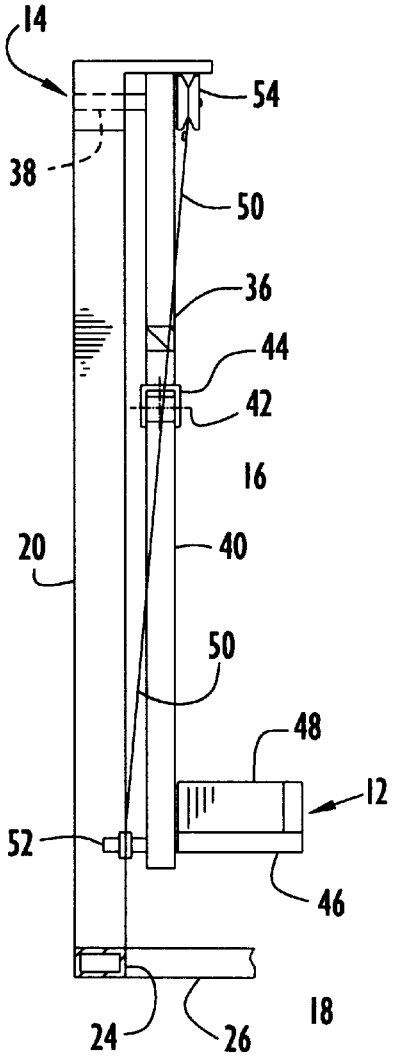
FIG. 3 is a fragmentary rear view, partly in section, of the exercise device shown in FIG. 1.

An exercise device 10 according to the present invention, as shown in FIGS. 1–3, includes a pair of foot supports 12 suspended from a frame 14 via linkages 16. Frame 14 is formed of tubular steel and includes a base 18 adapted to rest on a horizontal surface such as a floor, a pair of uprights 20 extending upwardly from a forward end of the base, and a hand rail 22 extending forwardly from upper ends of the uprights. Base 18 is of generally U-shaped configuration with a pair of parallel base members or legs 24 extending rearwardly from a transverse base member 26. Uprights 20 extend vertically to upward from opposite ends of transverse base member 26 to bends 28 where the uprights bend rearwardly at an angle (e.g., about 45°) relative to the vertical direction. Hand rail 22 is of generally U-shaped configuration with a pair of horizontal handle bars 30 of tubular configuration extending forwardly from upper ends of uprights 20 to a hollow housing 32 of generally rectangular configuration transversely connecting the bars. Bars 30 are shown covered with grips 34 in the form of foam sleeves but can be bare, covered with handlebar tape, provided with knurls or modified in any manner to improve the ability of the user to comfortably and securely grip the handrail when performing exercises.

Each linkage 16 includes an upper support or link 36 pivotally connected to the frame uprights at a hip pivot 38 and a lower support or link 40 pivotally connected to upper link 36 at a knee pivot 42, the knee and hip pivots being generally aligned with the knees and hips, respectively, of a user standing on the foot supports to permit the user to perform walking, striding and stepping exercises simply by altering their leg motion. Upper and lower links 36 and 40 are shown as straight bars in this embodiment, with a U-shaped socket or bracket 44 extending downwardly from a lower end of the upper link to receive an upper end of the lower link in pivoting relation so that the upper and lower links are laterally aligned with one another. Each foot support 12 includes a platform 46 fixed at an angle (e.g., perpendicular) relative to lower link 40 to follow the natural motion of the user's foot and a foot restraint 48 in the form of a toe kick preventing the foot from sliding off the platform in the forward direction. Foot supports 12 are shown connected by a drive cable 50 extending upwardly from pegs 52 on each foot support to hip pulleys 54 mounted coaxially with hip pivots 38. Cable 50 wraps over hip pulleys 54 and extends forwardly therefrom through handle bars 30 to a second set of pulleys 56 spaced forwardly of the hip pulleys within hand rail housing 32. Pulleys 56 reorient cable 50 to extend through housing 32 where the cable wraps completely around a force resisting mechanism in the form of a variable resistance pulley 58 disposed between pulleys 56. To achieve variable resistance, pulley 58 is rotatably mounted on a bolt 60 and disposed between frictional surfaces, for example, friction washers, so that tightening of the bolt with a threaded knob 62 increases the frictional forces resisting pulley rotation.

With cable 50 connecting foot supports 12, it will be appreciated that vertical movements of the foot supports can be linked or coupled in a coordinated way so that, for example, when one foot support is moved downwardly as a result of the user's motion, the other foot support is automatically moved upwardly and vice versa. Nevertheless, if cable 50 is routed directly from foot supports 12 to hip pulleys 54, a knee locking effect can occur whereby it is not possible to move the lower link upwardly when it is vertically aligned with the upper link due to the fact that the lifting force is being applied axially along the length of the links which are axially fixed relative to one another by the knee pivot. In accordance with the present invention, however, knee locking is prevented by maintaining the cable 50 at an angle relative to at least one of the links using an offset mechanism, for example by routing the cable around idler pulleys 64 mounted on spacers 66 extending rearwardly from upper links 36 as shown. Spacer 66 causes cable 50 to extend upwardly at an angle from the bottom of lower link 40 in the rearward direction so that a component of the cable tension acts perpendicular to the lower link causing the link to pivot in the counterclockwise direction looking at FIG. 2. A second linking mechanism, such as the pulleys and cord mechanism shown at 68 and 70 in FIG. 1, can optionally be used to couple forward and backward movement of the foot supports.

In use, exercise device 10 can be mounted by grasping hand rail 22 for stability and placing the feet on foot supports 12 as shown, for example, in FIG. 2. Users may then stand upright on the foot supports in a suspended state above the floor and perform realistic striding, stepping, and walking exercises simply by altering their leg motion. For example, users can perform a striding exercise to simulate skating or cross-country skiing by locking their legs in a straight or otherwise fixed position and swinging them forward and backward so that upper and lower links 36 and 40 pivot essentially as a unit about hip pivot 38 causing the foot supports to move along an arcuate path of substantially fixed radius centered near their hips. As the foot supports move along the arcuate path defined by the links, the angular orientation of the foot support platforms 46 relative to the floor corresponds substantially to the angular orientation of the user's feet thus contributing to the realistic feel of the device. The foot supports can be moved independently in this mode if desired since the legs of the user are essentially locked during the striding exercise and cable 50 does not move substantially; however, if a horizontal drive cable such as 70 is provided, movement of the foot supports can be coupled or linked in a coordinated manner so that rearward movement of one foot support will cause the other foot support to move forwardly.

Users can jog in place or perform a stair stepping exercise by standing upright as shown in FIG. 2 and alternately lifting and lowering each of their knees so that foot supports 12 move up and down in a generally vertical direction. As one foot support is lowered, the end of cable 50 attached to the foot support moves downwardly causing the other end of the cable to move upwardly thereby contributing to the upward movement of the other foot support such that movement of the legs is coupled or linked in a coordinated manner. As mentioned above, cable 50 is routed around spacers 66 extending rearwardly from upper inks 36 so that, in the event the upper and lower links hang vertically downward in linear alignment at some point during the exercise, cable tension is applied to the lower links at an angle so that a component of the applied force acts perpendicular to the lower links thereby causing the lower links to pivot relative to the upper links about the knee pivot.

A walking exercise can be performed by combining the striding and stepping motions described above so that the legs move forward and backward while the knees move up and down. Resistance to upward and downward movement of the legs can be varied by turning knob 62 to increase or decrease the friction acting on pulley 58. Alternatively and optionally, springs or other force resisting members, such as the bungy cords shown at 71 in FIG. 2, can be connected between the frame and one or both of the links, and/or between the links. If force resisting members in the form of springs are used, the springs can also serve to counterbalance the weight of the linkages to provide a more natural walking, striding, or stepping motion and can also absorb shock to the body.

While the hip pulleys 54 have been shown mounted coaxially with hip pivots 38, it will be appreciated that the hip pulleys can be mounted at various other locations on the frame or the linkages. For example, in FIG. 4, a hip pulley 54 is shown mounted forwardly of hip pivot 38 and, in FIG. 4*a*, a hip pulley 54 is shown mounted rearwardly of the hip pivot 38. As mentioned above, in order to prevent locking of the links in a linearly aligned or straightened condition, cable 50 can be routed at an angle relative to the links, for example using a spacer 66 extending rearwardly from the upper link 36. In FIG. 4, a modification of the anti-knee locking offset mechanism according to the present invention is shown wherein the spacer 66 extends rearwardly from the lower link 40 and the cable is attached at the terminal end of the spacer.

Figure 4A:
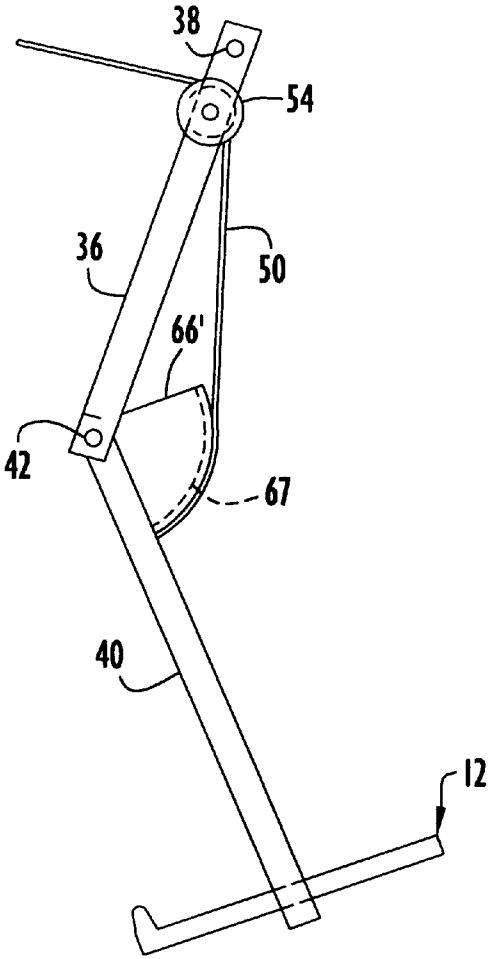
FIG. 4*a* is a fragmentary side view of another modified linkage and hip pulley arrangement according to the present invention.
Figure 4:
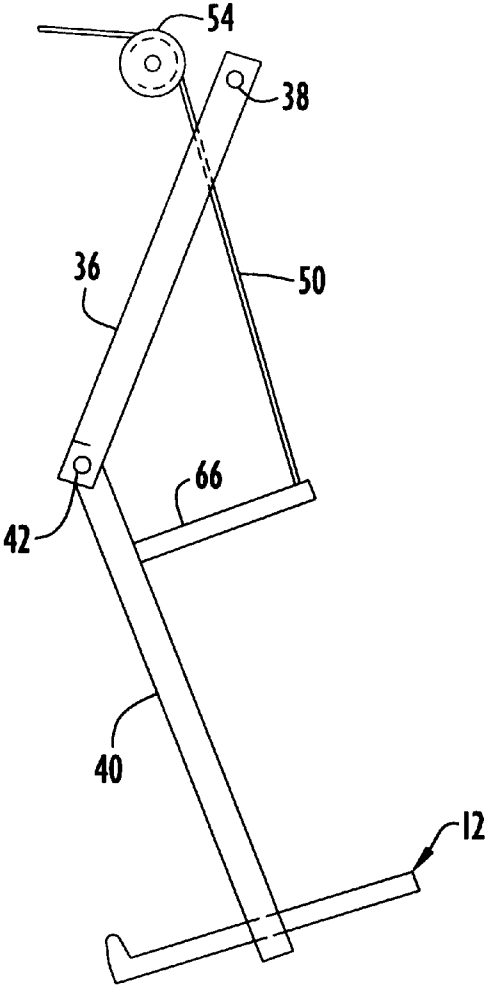
FIG. 4 is a fragmentary side view of a modified linkage and hip pulley arrangement according to the present invention.

Another modification of the anti-knee locking offset mechanism according to the present invention, shown in FIG. 4*a*, includes a spacer 66' in the form of a circular sector extending rearwardly from lower link 40 and defining a curved cable trace 67 around which cable 50 is routed, the cable being attached to the lower link and moving freely in and out of the curved cable trace as the lower link is rotated about knee pivot 42.

Figure 6:
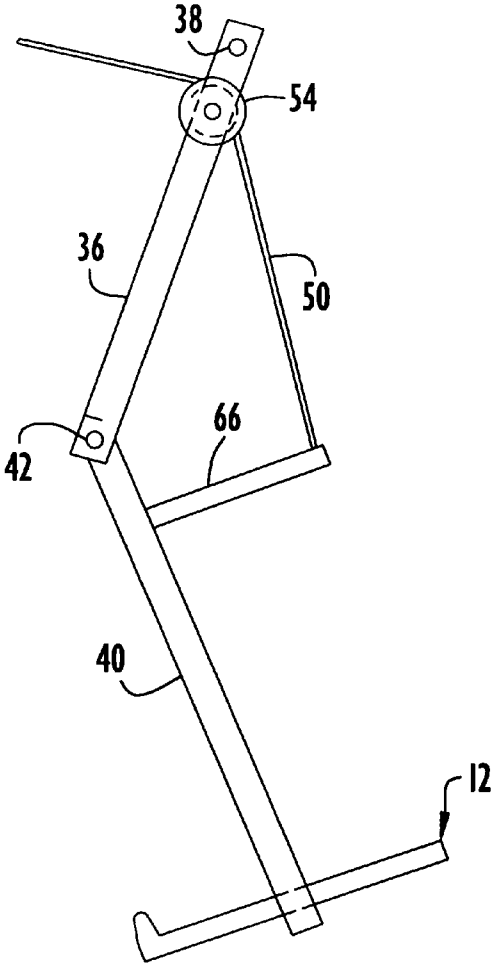
FIG. 6 is a fragmentary side view of yet another modified linkage and hip pulley arrangement according to the present invention.
Figure 5:
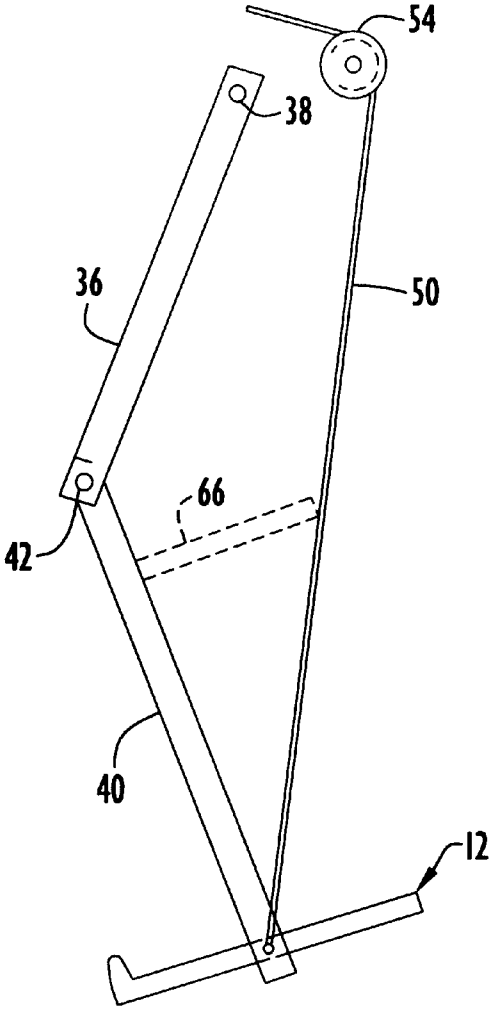
FIG. 5 is a fragmentary side view of another modified linkage and hip pulley arrangement according to the present invention.

The arrangement of the hip pulley 54 in FIG. 5 is another example of an anti-knee locking offset mechanism since the cable 50 is always oriented at an angle relative to one of the links due to the rearward position of the hip pulley 54 and is therefore able to counteract knee locking without the need for a rearwardly extending spacer. It will be appreciated, however, that a spacer can be mounted on one of the links in the embodiment of FIG. 5, for example as shown by phantom lines at 66. In FIG. 6, a hip pulley 54 is shown mounted on an upper link 36 below hip pivot 38.

Figure 7:
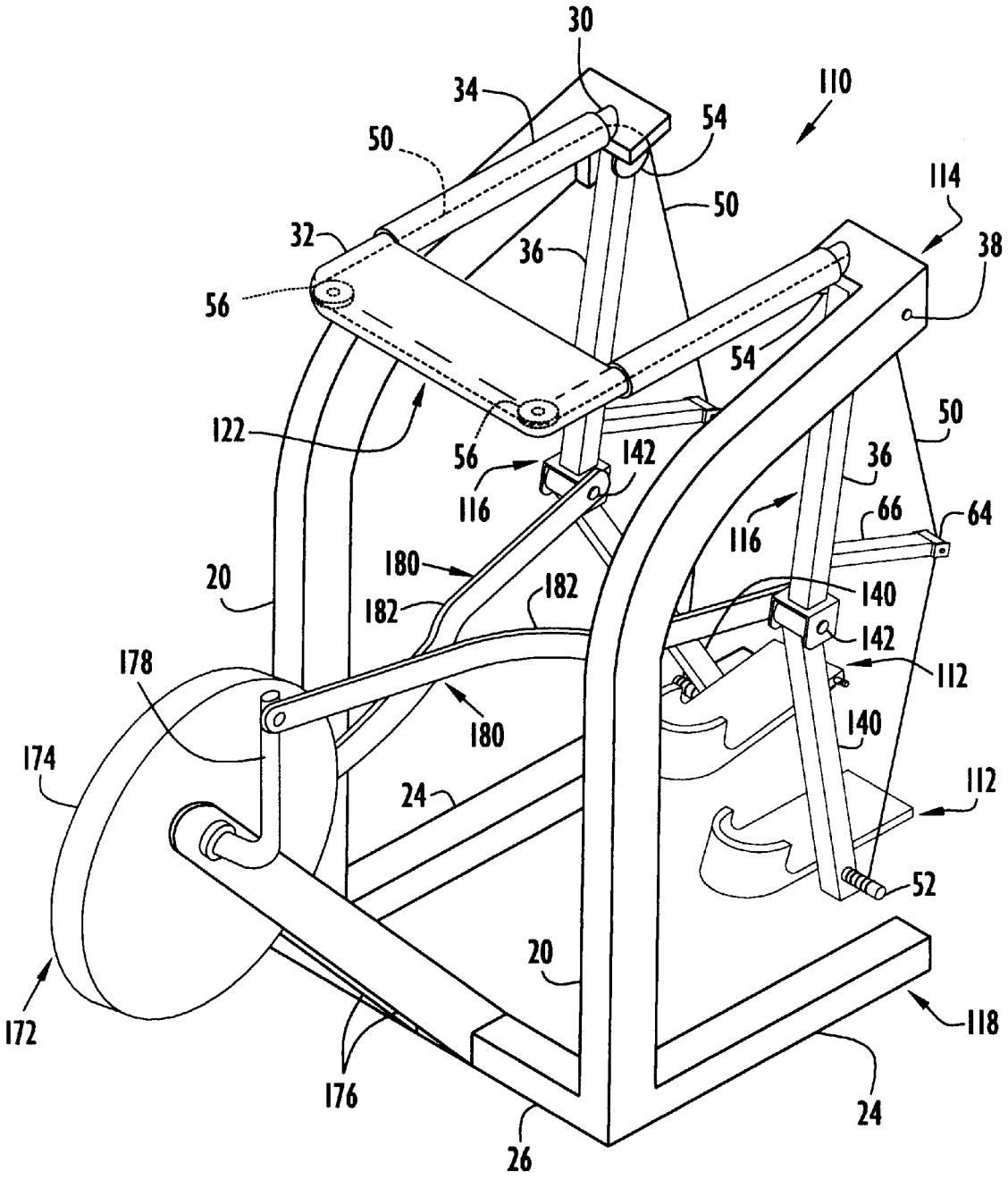
FIG. 7 is a perspective view of a modification of an exercise device according to the present invention utilizing a flywheel.

A modification of the exercise device according to the present invention, shown in FIG. 7 at 110, is similar to the exercise device shown in FIG. 1 but with a flywheel assembly 172 mounted forwardly of frame 114 and coupled with linkages 116. Flywheel assembly 172 includes a circular flywheel 174 mounted for rotation on a pair of arms 176 extending upwardly at an angle from horizontal base 118 in the forward direction. A pair of cranks 178 extend outwardly in opposite directions from the center of the flywheel 174 and are connected to knee pivots 142 via drive bars 180, the drive bars being pivotally connected to the knee pivots and extending forwardly therefrom to bent portions 182 where the bars bend inwardly in the lateral direction and then forwardly to connect pivotally with the cranks. Since drive bars 180 are pivotally connected to knee pivots 142 and cranks 178, when a user stands upon foot supports 112 and performs an exercise such as a bicycling or walking exercise, cranks 178 are driven by drive bars 180 in a circular motion causing flywheel 174 to rotate. Motion of foot supports 112 is thus linked horizontally by flywheel assembly 172 and, in addition, the flywheel provides additional resistance when the user initially begins to perform an exercise and later provides momentum carrying the user through the motions once the flywheel is rotating. Drive bars 180 can be pivotally connected anywhere on the lower links 140 and foot supports 112.

Figure 8:
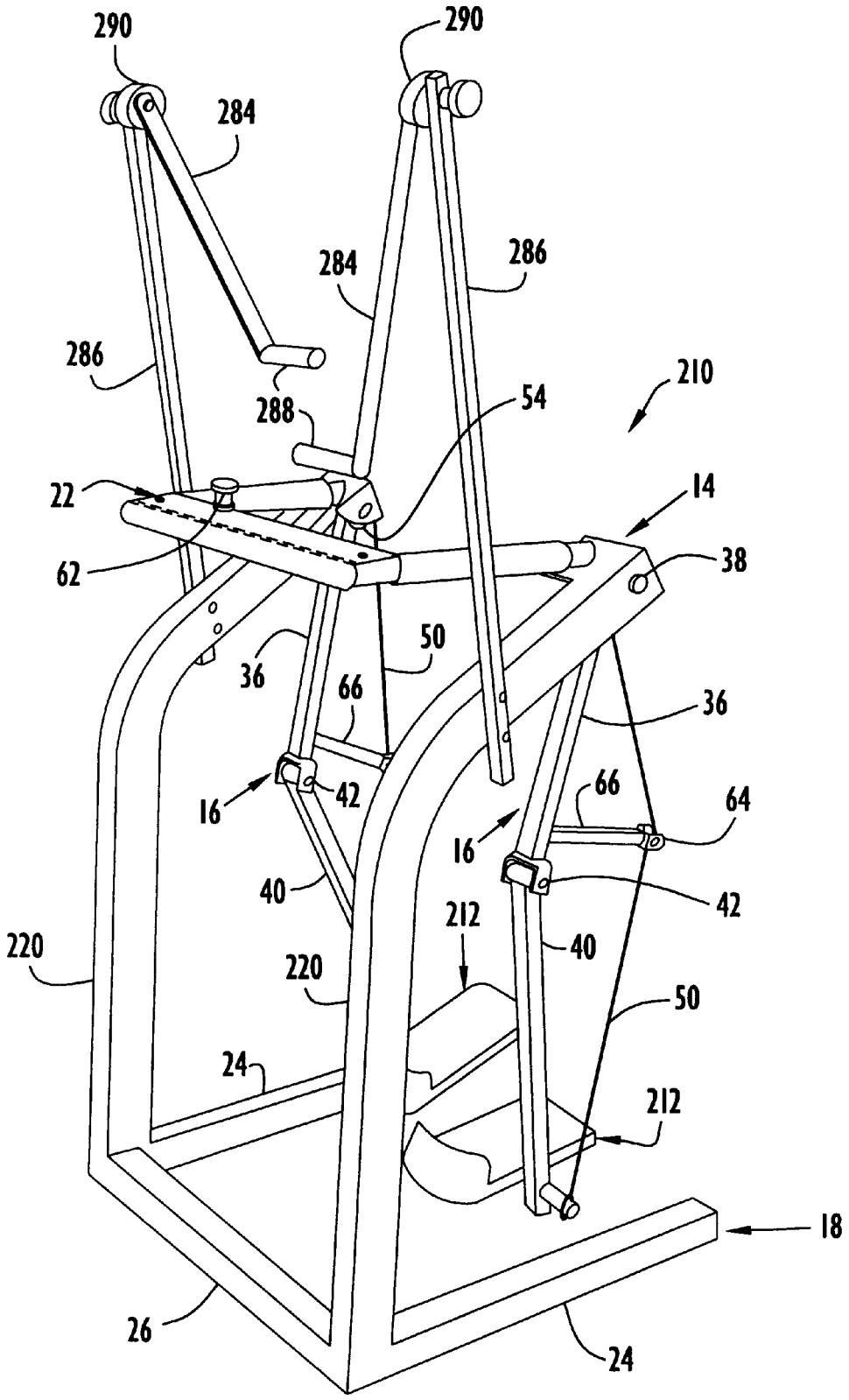
FIG. 8 is a perspective view of another modification of an exercise device according to the present invention utilizing arm levers.

Hand rail 122 can be grasped for stability when performing exercises; however, it is also possible to modify the exercise device to permit arm exercises to be performed in conjunction with the leg motions, for example, during striding, stepping and walking exercises. In FIG. 8, for example, a modification of the exercise device according to the present invention is shown wherein the modified exercise device 210 includes a pair of arm levers 284 extending downwardly from a pair of vertical frame extensions 286 to a pair of horizontal handles 288. Frame extensions 286 are bolted to uprights 220 of the frame and extend upwardly therefrom at a slight forward angle to a pair of variable resistance pivots 290. Levers 284 extend downwardly from pivots 290 and are rotatable thereabout by movement of handles 288. In use, handles 288 are grasped by the user and moved back and forth along arcuate paths having their respective centers of curvature at pivots 290 while at the same time performing leg exercises using foot supports 212. Since movement of the arm levers is not linked in this embodiment, users can move the arm levers in the same direction or in opposite directions dependent upon their preference.

Figure 9:
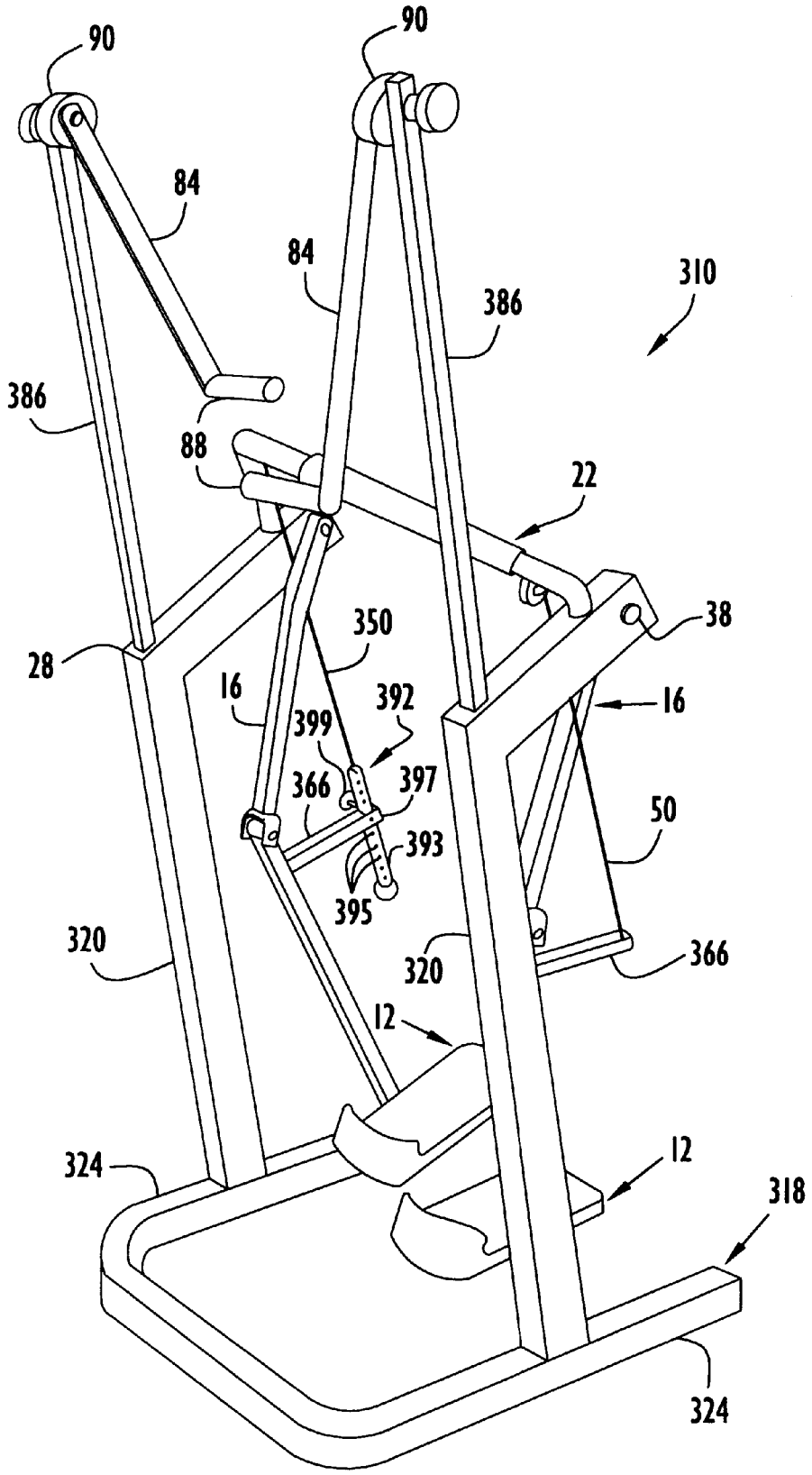
FIG. 9 is a perspective view of still another modification of an exercise device according to the present invention utilizing arm levers.

A further modification of the exercise device according to the present invention, shown in FIG. 9 at 310, is similar to the exercise device shown in FIG. 8 but with frame uprights 320 extending upwardly from medial portions of the legs 324 of base 318 and arm lever extensions 386 disposed telescopically within the frame uprights so that the entire arm lever assembly can be lowered relative to the frame when not in use. Any conventional mechanism can be used to lock the arm levers in the elevated or deployed position shown in FIG. 9, such as, for example, detents, buttons, pins or ratcheting members. When it is desired to move the arm lever assembly from the deployed position to a collapsed or undeployed position for storage, the locking mechanism is released and the arm lever assembly is lowered by forcing the arm lever extensions to slide downwardly within the frame uprights. An exemplary cable length adjustment device 392 is also shown in FIG. 9 at one end of cable 350 to adjust the length of the cable to alter the vertical range of motion of the foot supports. The adjustment device 392 includes a bar 393 extending generally vertically through an opening formed through one of the spacers 366 and having a plurality of axially spaced holed 395 formed transversely therethrough, holes 395 being individually alignable with a transverse hole 397 in the spacer to receive a pin 399. Any suitable mechanism for adjusting cable length can be used including, but not limited to, rotary knobs and reels as well as manually wrapping the cable around a peg a suitable number of turns (as shown in FIG. 1) until a desired length is obtained.

Figure 9A:
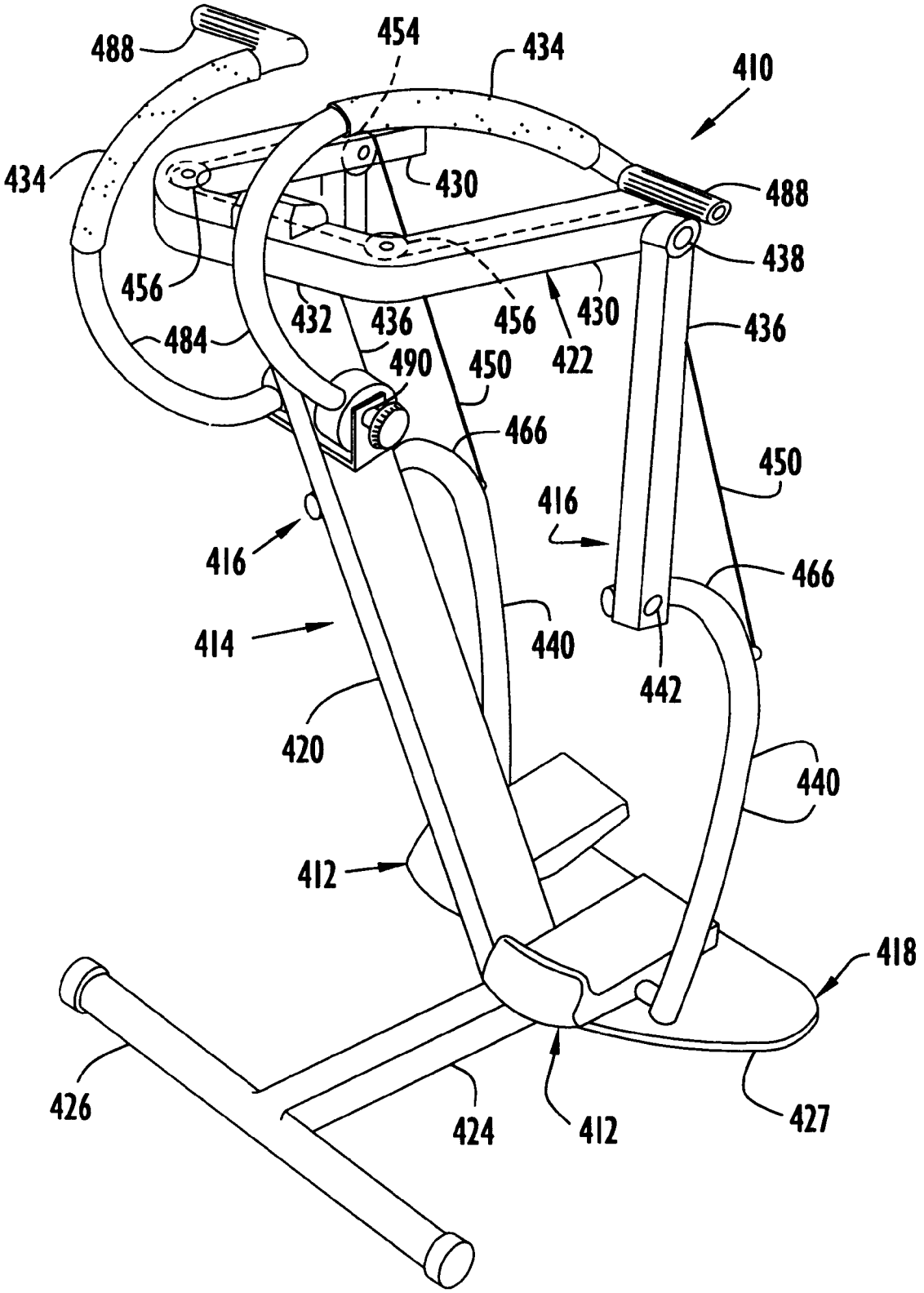
FIG. 9*a* is a perspective view of another modification of an exercise device according to the present invention utilizing different arm levers.

While the frames shown and described above each include a pair of uprights extending upwardly from a U-shaped base on opposite sides of the user, it will be appreciated that other frame configurations can be used. For example, in FIG. 9*a* a modification of the exercise device according to the present invention is shown wherein the frame 414 of the modified exercise device 410 includes a base 418 made up of longitudinally spaced base members 426 and 427 oriented transverse to the forward direction, a longitudinal base member 424 extending between respective central portions of the longitudinally spaced members, a central column or upright 420 extending upwardly from the longitudinal base member at an angle toward the front of the device, and a handrail 422 which extends rearwardly from the central column to support linkages 416. Hand rail 422 is of generally U-shaped configuration with a transverse portion 432 extending laterally outward in opposite directions from the top of central column 420, and a pair of longitudinal portions 430 extending rearwardly from opposite ends of the transverse portion to be disposed on opposite sides of a user standing on foot supports 412. The hand rail is shown in FIG. 9*a* as a one-piece unit formed of square tubing, with hip pulleys and forward pulleys being disposed at least partly within the handrail as shown by broken lines at 454 and 456, respectively. Upper links 436 are pivotally connected to longitudinal portions 430 of the hand rail at hip pivots 438. The upper links are straight and extend downwardly from hip pivots 438 in a generally vertical direction while each lower link 440 is bent or curved to define an offset portion 466 which extends rearwardly from knee pivot 442 and bends downwardly to connect with a foot support 412. Cable 450 extends upwardly from the offset portion of each of the lower links 440 to hip pulleys 454. From hip pulleys 454, cable 450 extends forwardly to the second set of pulleys 456 mounted on forward portions of hand rail 422. The modified exercise device 410 is also shown with optional arm levers 484 extending upwardly from variable resistance pivots 490 on central column 420 below handrail 422. Arm levers 484 curve rearwardly to connect with handles 488 extending laterally outward from the levers. A portion of each lever between pivot 490 and handle 488 is covered with a grip material 434 similar to that shown in FIG. 1 at 34 to function as an arm rest and to accommodate other hand positions. The user can also grasp handles 488 or grips 434 to move levers 484 back and forth along arcuate paths having their respective centers of curvature at pivots 490 while at the same time performing leg exercises using foot supports 412. Like the arm levers shown in FIGS. 8 and 9, movement of the arm levers in FIG. 9*a* is not linked to movement of the foot supports or each other so that users can move the arm levers in the same direction or in opposite directions dependent upon their preference.

Foot supports 412 can be fixed to the bottom of each linkage or pivotally connected thereto. Use of exercise device 410 is essentially the same as that described above in connection with exercise device 10, with respective bent, curved or offset portions of the lower links functioning like spacers 66 to prevent knee-locking by ensuring that a component of the cable tension is oriented to create a moment about knee pivot 442.

Figure 9B:
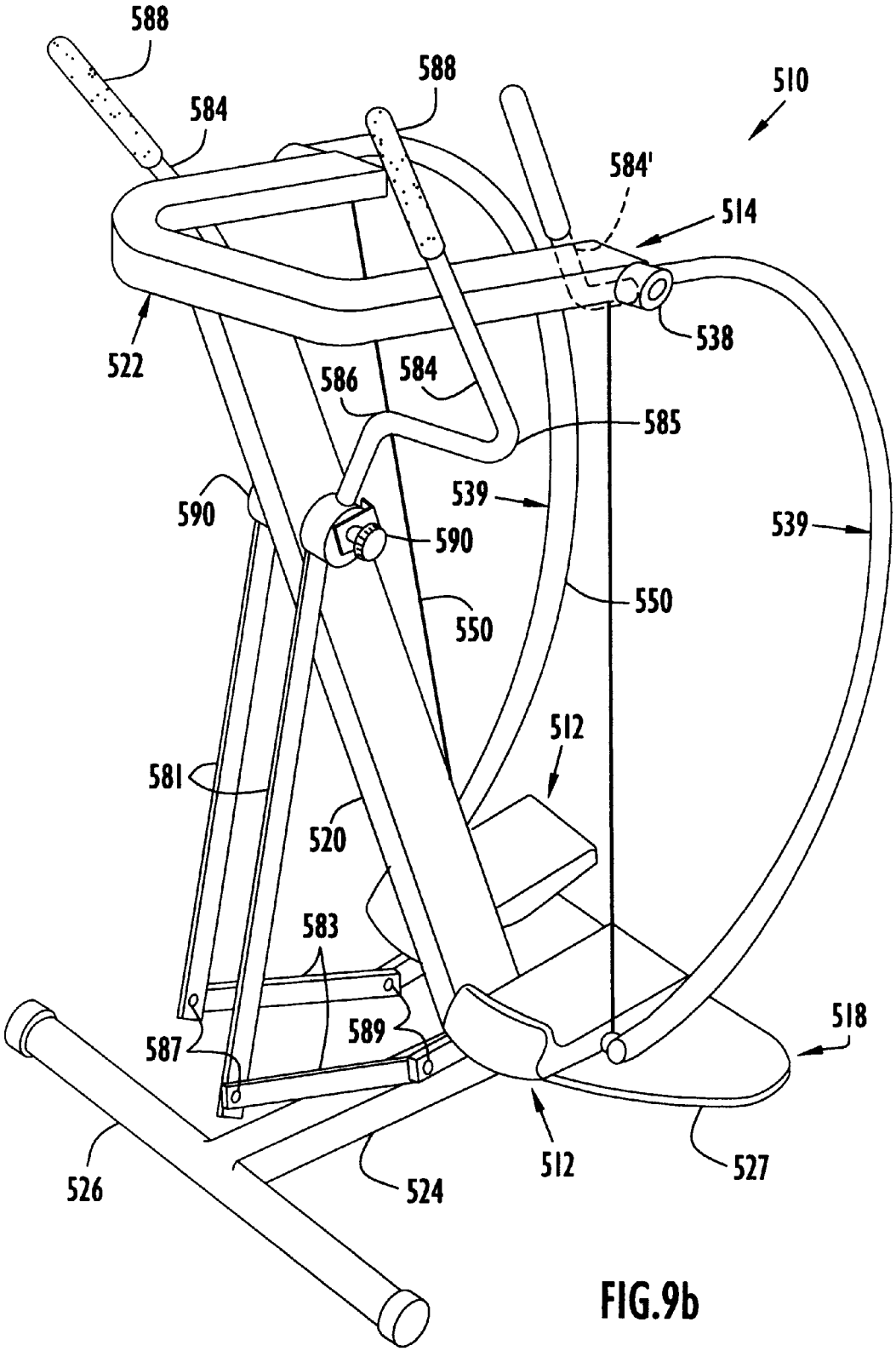
FIG. 9*b* is a perspective view of another modification of an exercise device according to the present invention utilizing different arm levers.

The modified exercise device shown in FIG. 9*b* at 510 is similar to the exercise device shown at 410 in FIG. 9*a* but with curved, links 539 extending downwardly from frame 514 and optional arm levers 584 linked to foot supports 512. Frame 514 includes a base 518 made up of longitudinally spaced base members 526 and 527 oriented transverse to the forward direction, a longitudinal base member 524 extending between respective central portions of the longitudinally spaced members, and a central column or upright 520 extending upwardly from the longitudinal base member at an angle toward the front of the device. Links 539 are bowed or curved outwardly in the rearward direction, with an upper end of each linkage being pivotally connected to frame 514 at a hip pivot 538 and a lower end of each link being connected to a foot support 512. The links are formed of an elastic material with a cross-sectional configuration to flex or straighten somewhat under the weight of a user standing on foot supports 512, the links tending to unflex or return to their original curvature or shape when unloaded. Drive cord or cable 550 is shown extending directly upward from foot supports 512 to the hip pulleys (not shown). Each arm lever 584 extends upwardly from a variable resistance pivot 590 to a first bend 586 where the lever turns laterally outward, the lever extending from the first bend to a second bend 585 spaced laterally outward of handrail 522. The lever extends upwardly from the second bend to a handle 588 which can be grasped by the user like a ski pole during operation of the exercise device. Movement of the arm levers 584 about pivots 590 is linked with movement of foot supports 512 by an arm linking mechanism including a first link 581 extending downwardly from pivot 590, and a second link 583 extending rearwardly from a pivot 587 at the bottom of the first link to a pivot 589 on the foot support.

In use, the weight of a user standing of foot supports 512 will cause links 539 of the modified exercise device 510 to flex or straighten somewhat until drive cord 550 is taut. All of the exercises described above may then be performed in essentially the same manner as described above with the links 539 flexing and unflexing to accommodate vertical components of the user's foot motion. The rearward bow or curvature of the links also ensures proper orientation of foot supports 512 as the links rotate about the hip pivots and flex or straighten. Arm levers 584 move with foot supports 512 so that, for example, when a foot support moves forward, the corresponding arm lever moves rearward, and vice-versa. An alternative arm lever configuration wherein the arm lever extends upwardly from the linkages is also shown by broken lines at 584' in FIG. 9*b*. While a curved, one-piece flexible linkage is shown in FIG. 9*b*, it will be appreciated that multiple curved links can be connected together in any suitable manner to form linkages for supporting the foot supports.

Figure 10:
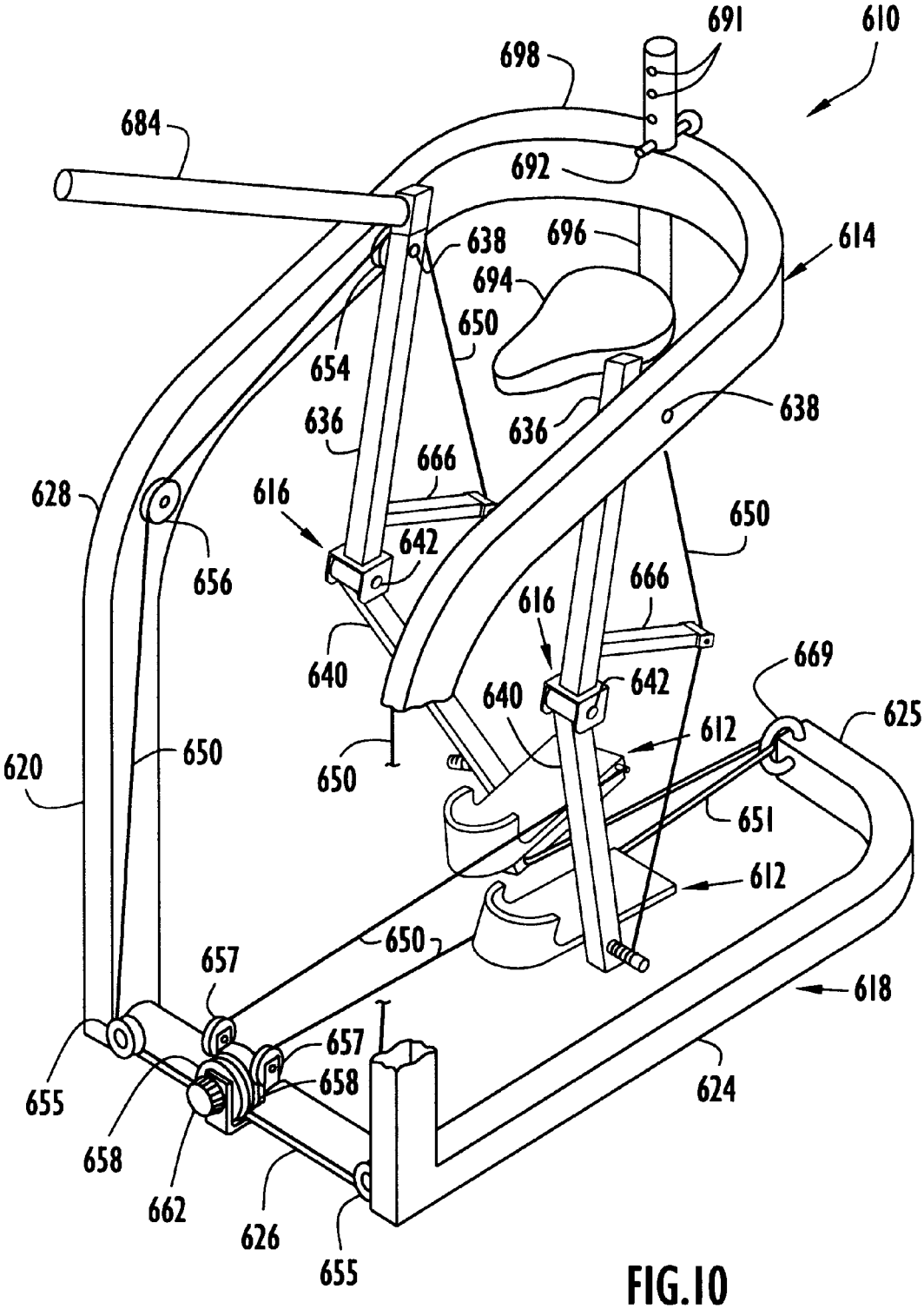
FIG. 10 is a perspective view of yet another modification of an exercise device according to the present invention.

Another modification of an exercise device according to the present invention is shown in FIG. 10 at 610 wherein an arm lever 684 extends forwardly from upper link 636 at an angle (e.g., perpendicularly) to couple arm movements with the leg movements, for example during striding, stepping, and walking exercises. Linkages 616 each include an upper link 636 and a lower link 640 pivotally attached to each other at a knee pivot 642. Upper links 636 each pivotally connect with frame 614 at a hip pivot 638. Lever 684 is shown as a straight bar or pole extending forwardly from an upper end of link 636, but can be bent or curved or attached anywhere along upper link 636 at any desired angular orientation. Frame 614 is also modified in FIG. 10 to illustrate a number of other features such as, for example, a seat 694 suspended from a tube 696 extending downwardly from a portion 698 of frame 614 connecting upper ends of frame uprights 620, the tube 696 being provided with axially spaced holes 691 and a pin 692 insertable into the holes above frame position 698 to permit the height of the seat to be adjusted relative to the frame. Uprights 620 each extend upwardly from a base 618 to a bend 628, and extend rearward to portion 698 where the upper ends of uprights are connected together. Frame 614 is also shown with a transverse extension 625 at the rear of leg 624 of base 618 to mount a capstan or pulley 669 behind foot supports 612 so that an additional cable 651 can be connected between the foot supports to prevent simultaneous forward movement of the foot supports which might compromise stability of the user in the event a hand lever or hand rail is not gripped. Also shown in FIG. 10 is a modified cable and pulley mechanism allowing variable resistance to be applied to vertical and horizontal motion of the foot supports 612 using a pair of cables 650 and a single knob 662. Each cable 650 is routed upwardly from a foot support 612 around a spacer 666 to hip pulley 654 where the cable is redirected forwardly to an upper pulley 656 located forwardly of the hip pulley. Upper pulley 656 redirects cable 650 downwardly to a lower pulley 655 at one end of base member 626 which redirects the cable laterally inward along the transverse base member to a variable resistance pulley 658. Pulley 658 redirects the cable upwardly to a pulley 657 which redirects the cable rearwardly to connect with the other foot support. Vertical and horizontal motion of the foot supports 612 are thus coupled with two cords or cables which wrap around a pair of coaxial variable resistance pulleys 658 such that resistance can be adjusted with a single knob 662 when pulleys 658 are mounted between frictional surfaces in the manner described above.

Figure 11:
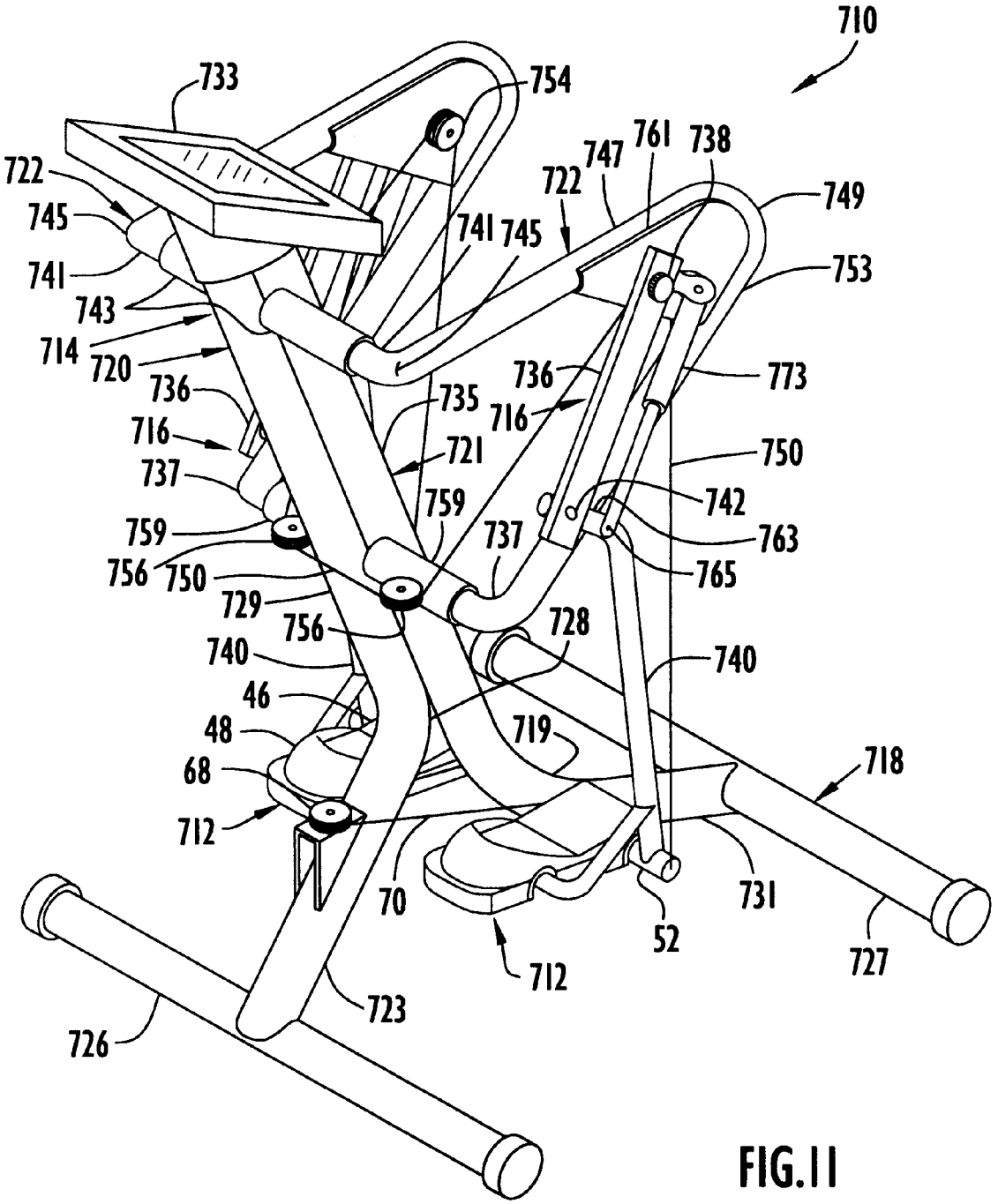
FIG. 11 is a perspective view of a further modification of an exercise device according to the present invention.
Figure 12:
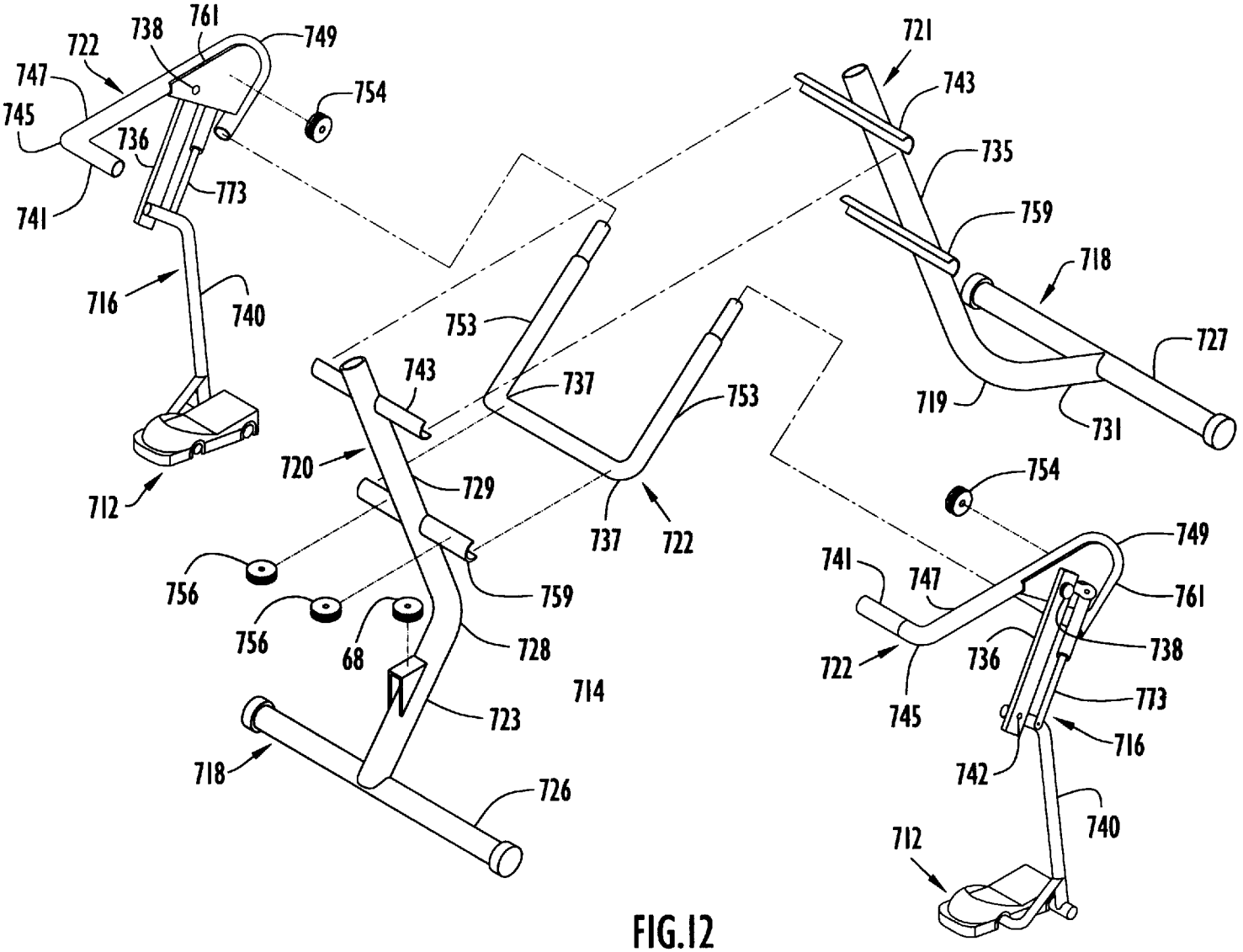
FIG. 12 is an exploded view of the exercise device shown in FIG. 11.

While the frames shown and described above each include a pair of uprights extending upwardly from a U-shaped base on opposite sides of the user, it will be appreciated that other frame configurations can be used. For example, in FIGS. 11 and 12, a modification of the exercise device according to the present invention is shown wherein the frame 714 of the modified exercise device 710 includes a base 718 made up spaced parallel members 726 and 727 oriented transverse to the forward direction, a pair of uprights 720 and 721 which extend upwardly from respective central portions of the base members and join together to define a central column, and a handrail 722 which extends rearwardly from the central column to support linkages 716. Front upright 720 includes a lower portion 723 extending rearwardly from the center of the front base member 726 at an upward angle to a bend 728 and an upper portion 729 extending forwardly from the bend at an upward angle to a display unit 733. Rear upright 721 includes a substantially horizontal lower portion 731 extending forwardly from the rear base member 727 to a bend 719 and an upper portion 735 extending forwardly from the bend at an upward angle in parallel relation to the upper portion 729 of front upright 720, the upper portions 729 and 735 of uprights 720 and 721, respectively, being connected along their lengths to define a central column of the device. Hand rail 722 is shown as a pair of tubes, each of which includes an upper transverse portion 741 extending laterally outward from a first bracket 743 on one side of the central column to a first bend 745, a generally horizontal portion 747 extending rearwardly from the first bend to a second bend 749, a downwardly angled portion 753 extending forwardly from the second bend to a third bend 737 to connect with a bracket 759 on the central column below the first bracket.

Mounting plates 761 are mounted at the junction between horizontal and downwardly angled portions of hand rails 722, with linkages 716 extending downwardly from a hip pivot 738 on each mounting plate. Upper links 736 are straight and extend downwardly from hip pivots 738 in a generally vertical direction while each lower link 740 includes an offset portion 763 which extends rearwardly from knee pivot 742 to a bend 765 where the lower link turns downwardly to connect with foot support 712. Cable 750 extends upwardly from the bottom of each of the lower links 740 to hip pulleys 754 mounted rearwardly of hip pivots 738 on mounting plates 761. From hip pulleys 754, cable 750 extends forwardly at a downward angle to a second set of pulleys 756 mounted on lower transverse portions of hand rail 722. Force resisting members 773 in the form of pistons are also shown connected between the mounting plates 761 and the respective offset portions of lower links 740. Use of exercise device 710 is essentially the same as that described above in connection with exercise device 10, with the offset hip pulley locations and respective offset portions of the lower links combined to prevent knee-locking by ensuring that a component of the cable tension is oriented to create a moment about knee pivot 742.

Figure 13:
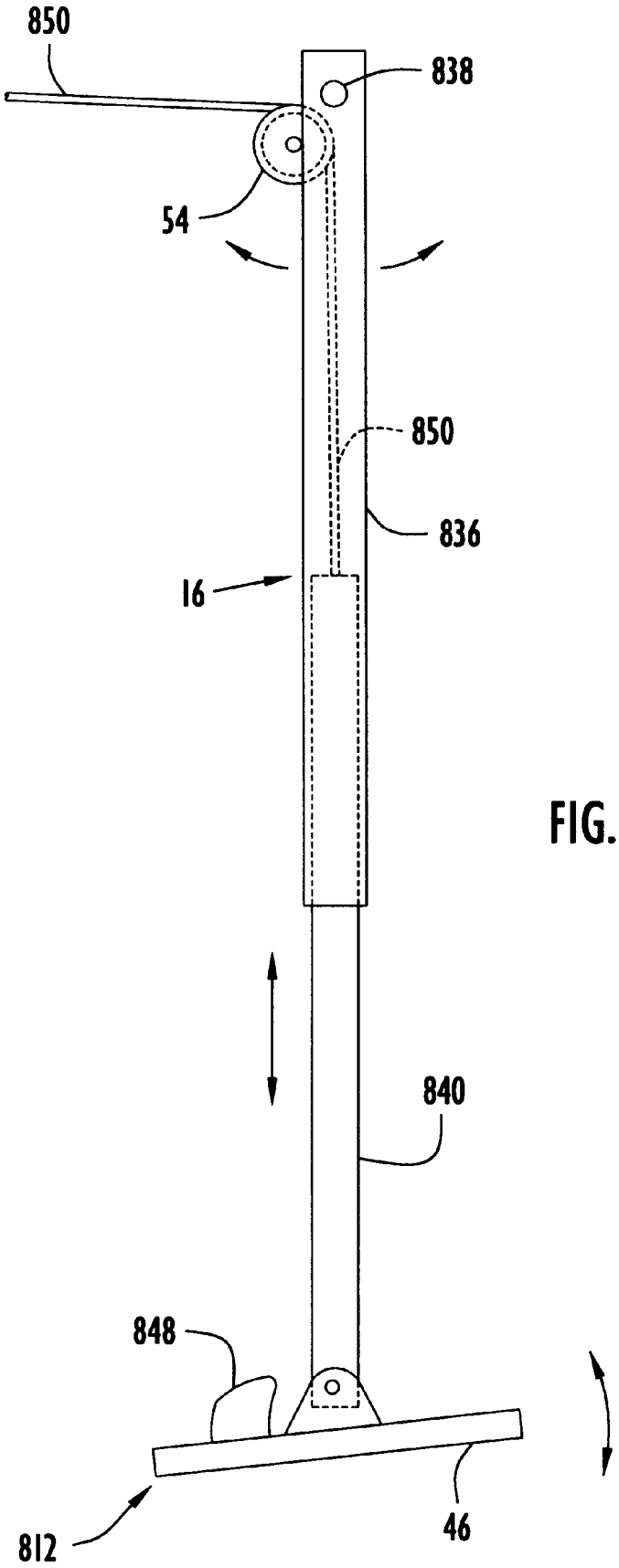
FIG. 13 is a fragmentary side view of a modified linkage for use with an exercise device according to the present invention.

A further modification of the exercise device according to the present invention is shown in FIG. 13 wherein an upper link 836 is hollow and a lower link 840 is telescopically fitted with the hollow upper link. Cable 850 is attached between upper ends of lower links 840, and foot supports 812 are pivotally connected to the lower ends of links 840. A foot restraint 848 in the form of a foot strap which extends over the foot is also shown to permit upward lifting of the foot to be transmitted to the lower link as well. In operation, foot supports 812 can be moved in essentially the same manner as described above without a knee pivot by causing the foot supports to swing about hip pivots 838 alone or in combination with vertical movement of the foot supports caused by lifting of the knees. It will be appreciated that either link can be made to move telescopically within the other link in order to obtain vertical movement of the foot support.

Figure 14:
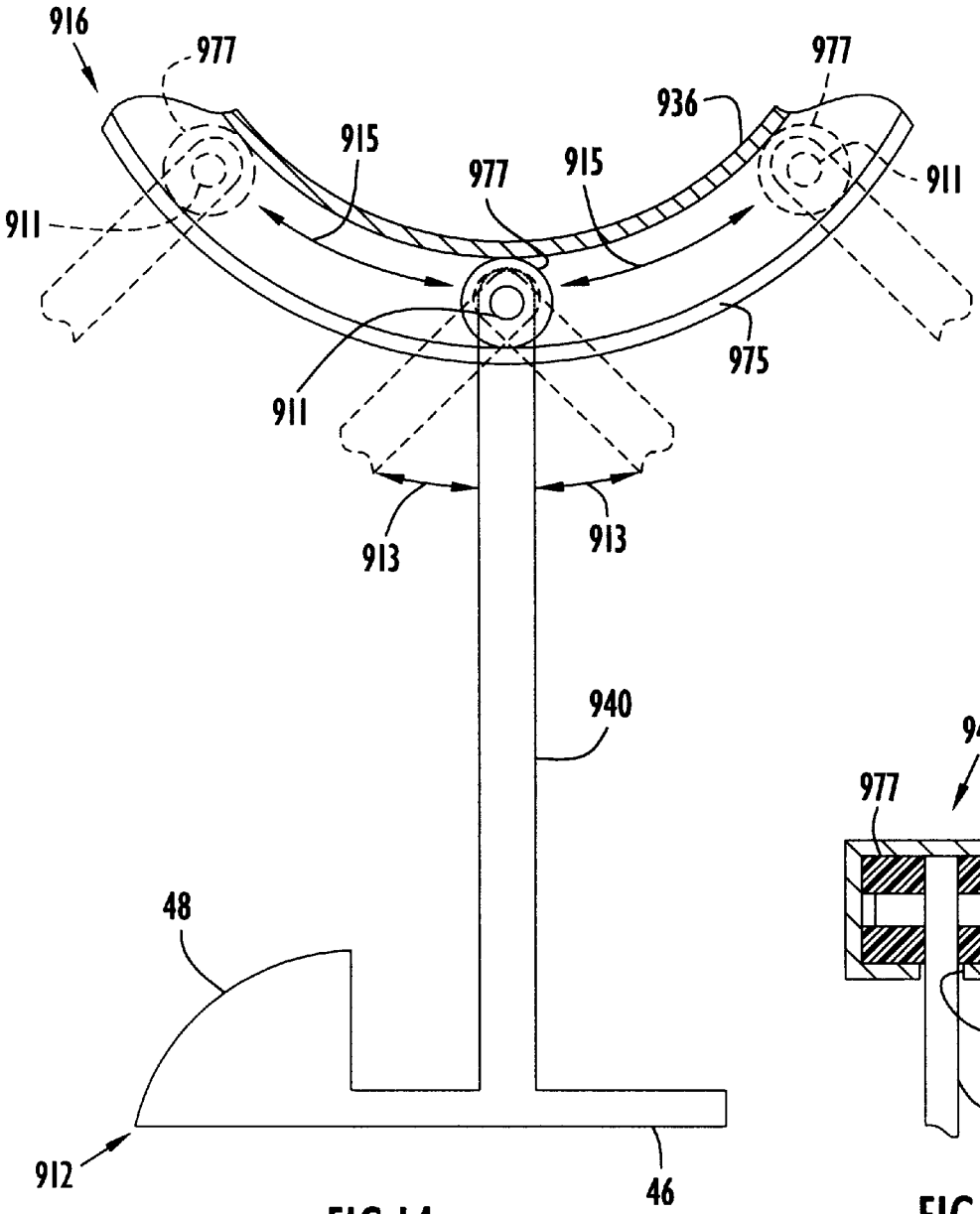
FIGS. 14 and 15 are a fragmentary side view and sectional view, respectively, of yet another modified linkage for use with an exercise device according to the present invention.
Figure 15:
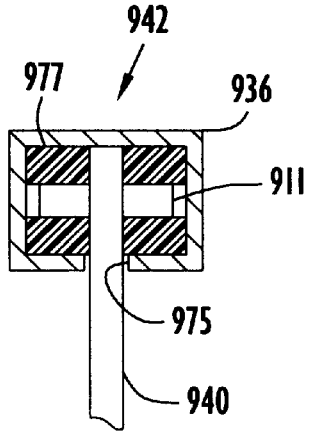

FIGS. 14 and 15 illustrate a modified linkage for use with the exercise device according to the present invention wherein the modified linkage 916 includes an upper link 936 in the form of a track mounted on the frame (not shown) and a lower link 940 suspended vertically from the track. Track 936 is shown as a curved length of square tubing having a longitudinal slot 975 formed along the convex side of the tubing. Lower link 940 extends upwardly from foot support 912 through slot 975 and terminates at a pin 911 disposed within the tubing. Pin 911 extends transversely from opposite sides of the lower link and carries a pair of bearing sleeves or rollers 977 made of suitable bearing material, such as plastic, to define a knee pivot 942 about which the lower link can pivot as indicated by arrows 913. The bearing sleeves also permit translational movement of the lower link along the track as indicated by arrows 915. The track can define a linear or curved path but is preferably circular as shown with a center of curvature corresponding approximately to the location of the user's hips to define a path of movement for the lower link corresponding to the path of movement defined by an upper link pivotally connected to the frame at a hip pivot.

Figure 16:
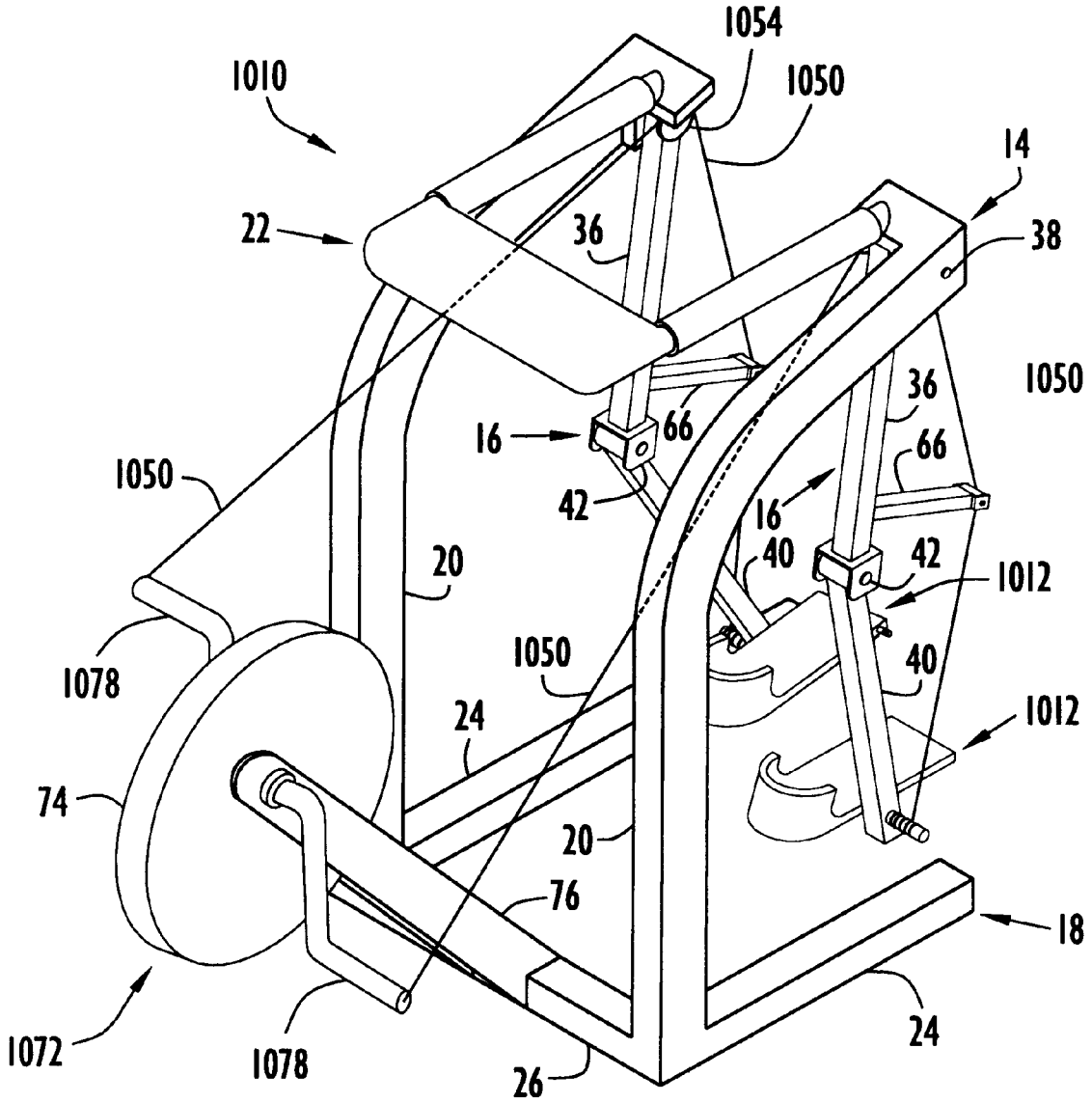
FIG. 16 is a perspective view of another modification of an exercise device according to the present invention utilizing a flywheel.

A knee bend cord 1050 may directly attach one linkage to the other or the cord may be interrupted and attached to a frictional and/or continuous motion device. In FIG. 16, for example, a modification of an exercise device according to the present invention is shown wherein the modified exercise device 1010 is similar to the exercise device shown in FIG. 7 but with two cables or cords 1050 extending rearwardly from cranks 1078 to hip pulleys 1054 and downwardly from the hip pulleys to foot supports 1012. By attaching the knee bend cables to cranks 1078 of the flywheel assembly 1072, the modified exercise device 1010 provides vertical linking of foot supports 1012 as well as contributing to a continuous motion during the performance of exercises. The flywheel can be mounted anywhere relative to the frame and it will be appreciated that multiple flywheels can be used if desired. Furthermore, the flywheels can be solid, hollow, or provided with vents or blades to increase air resistance during rotation and can be coupled with the linkages in any suitable manner including, but not limited to, the use of cords, drive bars, gears, and linkages.

From the above, it will be appreciated that the exercise device according to the present invention permits a user to stand upright on a pair of foot supports suspended from a frame and perform walking, striding and stepping exercises without mechanically adjusting the device.

The frame can have any configuration to support a user standing on the foot supports including, but not limited to, configurations wherein one or two uprights extend upwardly from a horizontal base or configurations where the frame is mounted on or part of a wall or ceiling. Any suitable structural members can be used in fabricating the frame including, but not limited to, solid or hollow members formed of metal, plastic or reinforced plastic materials.

The links can be straight, curved or angled and can be formed of any suitable material, such as plastic or reinforced plastic, in solid or hollow configurations. While the linkages preferably include two links, it will be appreciated that any number of links can be used to suspend the foot supports from the frame. Preferably, the upper and lower links correspond substantially in overall length to the length of a user's thighs and knees, respectively, to provide the greatest degree of realism possible. One or both of the upper and lower links can be configured to have an adjustable length, for example, by forming one or both of the links using telescoping members which are threadably connected so that users can change the length of the links to suit their preference. As mentioned above, the upper link can also be a track defining a path of movement for the pivoted upper end of the lower link. While such a track is shown and described herein as being formed of square tubing, it will be appreciated that other configurations are can be used including but not limited to, configurations wherein the rollers on each side of the linkage rest upon separate tracks or configurations wherein the lower linkage is suspended from a bracket extending around the track.

The foot supports are preferably fixed relative to the lower links but can be made to pivot relative to the lower links if desired. In addition, the foot supports can extend inwardly or outwardly of the linkages or be disposed beneath, to the rear of or forwardly of the linkages. The lower links can be attached to the foot supports near the front, rear or medial portions of the foot supports. The foot supports are preferably provided with the foot restraints to, among other things, prevent the user's feet from sliding off the foot support platforms in a forward direction; however, foot supports without restraints can also be used. While foot restraints in the form of toe kicks and straps have been illustrated and described, it will be appreciated that other types of foot restraints can be used including, but not limited to, clips, suction devices and tacky surfaces. Foot restraints in the form of heel kicks may also be provided on the rear or medial portions of the foot supports, if desired.

Movement of the foot supports can be linked or coupled in any manner desired including, but not limited to, use of cables and cords or the like, linkages, gears, levers, clutches and/or other types of force transmitting components and couplings. For example, vertical movement of the foot supports can be linked using a cable and pulley mechanism as shown. When a hip pulley is used it can be coaxial with the hip pivot, or the hip pulley can be vertically and/or horizontally spaced from the hip pivot. The locations of the other pulleys illustrated and described herein are merely exemplary of the many possible pulley locations. Configurations utilizing fewer or more pulleys can also be used depending upon the desired path for the cord. When the cord is used to link vertical movement of the foot supports, the length of the cord can be adjustable to vary the vertical range of movement. For example, longer cord lengths can be used to simulate walking whereas shorter cord lengths can be used to simulate high walk step, jogging, running and stepping. The exercise device according to the present invention can also be used without coupling movement of the foot supports. Furthermore, force resisting members such as springs or cylinders can be connected between the foot supports and the frame, between links, or between links and the frame. The exercise device can also be partly or wholly immersed in a liquid or a force-resisting field during use.

The cord and pulley mechanism illustrated for linking vertical and horizontal movement of the foot supports are merely exemplary of the types of linking mechanisms that can be used. For example, it is also possible to link horizontal movement of the foot supports by connecting upper links of the device using a bar pivotally connected to the frame between the links or by connecting a flywheel with the linkages. When a hip pulley is used it can be located at or near the location of the hip pivot or can be located forwardly or rearwardly of the hip pivot location. In addition, a hip pulley can be vertically spaced from the hip pivot or mounted on one of the links. The locations of the other pulleys illustrated and described herein are merely exemplary of the many possible pulley locations. When a cord is used to link vertical movement of the foot supports, the length of the cord can be adjustable to vary the vertical range of movement. Longer cords simulate walking on level surfaces whereas shorter cord lengths simulate walking on inclined surfaces.

While various mechanisms have been illustrated and described herein for preventing locking of the linkages at the knee pivot when vertical movement of the foot supports is coupled or linked, it will be appreciated that any mechanism causing the coupling forces to be applied at an angle relative to one of the linkages can be used.

Force resisting members can be attached between individual links and the frame or between links to counterbalance the weight of the foot supports and the linkages and to assist in lifting the legs when performing exercised with the exercise device according to the present invention. Any type of force resisting member can be used including, but not limited to, elastic members such as rubber bands or springs, fluid-damped pistons, variable resistance pulleys, weights, flywheels and frictional devices.

While walking, striding and stepping exercises have been described, it will be appreciated that other types of exercises can also be performed by performing variations of the above exercises including, but not limited to, exercises which realistically simulate running, bicycling, and skating. If desired, a seat can be mounted on the frame to permit a user to perform exercises while in a seated position, for example, by configuring the frame to extend behind the user and suspending the seat from a post extending downwardly from the frame.

Various accessories such as timers and pulse monitoring devices can be mounted on the frame within the view of the user to provide information relating to the performance of the exercises or the condition of the user as well as to entertain or add to the appeal of the device.

The exercise device according to the present invention can also be configured to include a harness which is worn by the user to increase the muscle challenge to the user by simulating an increase in gravity. The harness can be attached to the frame, the foot supports, or the hip pivots, or any combination of the foregoing, using springs, stretch cords or any other suitable means of attachment. Attachment of the leg elements or links of the device counterbalance the additional downward force to the user by creating upward force on the device components.

The components of the exercise device of the present invention can be made of any suitable materials and can be made of multiple parts of various configurations to simplify assembly and reduce manufacturing and shipping costs.

The features of the various embodiments described above can be combined in any manner described dependent upon the operational requirements of the exercise device.

Inasmuch as the present invention is subject to many variations, modifications and changes in detail, it is intended that all subject matter discussed above or shown in the accompanying drawings be interpreted as illustrative only and not be taken in a limiting sense.

Accordingly, the improved exercise device apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the exercise device is constructed and used, the characteristics of the construction, and the advantageous new and useful results obtained; the new and useful structures, devices, elements, arrangements, parts, and combinations are set forth in the appended claims.

I claim:

1. An exercise device for use by a user, said exercise device comprising:

a frame;

first and second linkages pivotally carried by said frame, each of said linkages including an upper link and a lower link; each of said upper links being pivotally connected to said frame, each of said lower links being pivotally connected to said upper link;

first and second foot supports, said first foot support carried by said lower link of said first linkage and said second foot support carried by said lower link of said second linkage; and means for coupling the movement of said first foot support and said second foot support whereby the user of the exercise device may perform a walking, striding, or stepping exercise without reconfiguring the exercise device.

2. The exercise device of claim 1, wherein said coupling means includes a first cable coupling the movement of said foot supports such that said second foot support is pulled upwardly when said first foot support is driven downwardly.

3. The exercise device of claim 2, wherein said first cable is connected to said lower link.

4. The exercise device of claim 3, wherein said coupling means includes a hip pulley carried by said frame adjacent each pivotal connection between said linkages and said frame, said first cable engaging said hip pulley.

5. The exercise device of claim 4, wherein the rotational axis of said hip pulley is offset from said pivotal connection between said linkage and said frame.

6. The exercise device of claim 4, wherein the rotational axis of said hip pulley is coaxial with said pivotal connection between said linkage and said frame.

7. The exercise device of claim 4, wherein said coupling means includes at least one second pulley carried by said frame, said first cable contacting said second pulley.

8. The exercise device of claim 7, wherein at least one of said second pulleys is a variable resistance pulley.

9. The exercise device of claim 3, wherein said lower link has a longitudinal axis, said first cable forming a nonzero angle with said longitudinal axis.

10. The exercise device of claim 9, further comprising a spacer connected to said lower link, said first cable contacting said spacer.

11. The exercise device of claim 1, wherein said coupling means includes a second cable coupling the movement of said foot supports such that said second foot support is pulled forward when said first foot support is driven rearwardly.

12. The exercise device of claim 11, wherein said coupling means includes a third pulley carried by said frame outset from said first and second foot supports, said second cable contacting said third pulley.

13. The exercise device of claim 1, further comprising at least one force resisting member that extends between said frame and each of said lower links.

14. The exercise device of claim 13, wherein said force resisting member is in the form of a piston-cylinder device.

15. The exercise device of claim 13, wherein said force resisting member is in the form of at least one bungy cord.

16. The exercise device of claim 1, further comprising a flywheel rotatably carried by said frame, a crank set carried by said flywheel, and second means for coupling the movement of said crank set to the movement of said foot supports.

17. The exercise device of claim 16, wherein said second means for coupling cooperates with said first means for coupling.

18. The exercise device of claim 16, wherein said second means for coupling includes first and second drive bars, said first drive par connecting said crank set to said first linkage; and said second drive bar connecting said crank set to said second linkage.

19. The exercise device of claim 1, further comprising arm levers pivotally carried by said frame.

20. The exercise device of claim 1, further comprising arm levers carried by and movable with each of said linkages.

* * * * *